US006261145B1

(12) United States Patent
Lee et al.

(10) Patent No.: US 6,261,145 B1
(45) Date of Patent: Jul. 17, 2001

(54) METHOD OF PACKAGING A FIELD EMISSION DISPLAY

(75) Inventors: Jin Ho Lee; Ju Youn Cha; Kyoung Soo Suh; Kyoung Ik Cho, all of Taejon-Shi (KR)

(73) Assignee: Electronics and Telecommunications Research Institutes, Taejon-Shi (KR)

( * ) Notice: Subject to any disclaimer, the term of this patent is extended or adjusted under 35 U.S.C. 154(b) by 0 days.

(21) Appl. No.: 09/199,385

(22) Filed: Nov. 25, 1998

(30) Foreign Application Priority Data

Nov. 25, 1997 (KR) ..... 97-62889

(51) Int. Cl.[7] ..... H01J 9/26
(52) U.S. Cl. ..... 445/25
(58) Field of Search ..... 445/24, 25, 43

(56) References Cited

U.S. PATENT DOCUMENTS

| | | | | |
|---|---|---|---|---|
| 5,788,551 | | 8/1998 | Dynka et al. . | |
| 5,807,154 | | 9/1998 | Watkins . | |
| 5,827,102 | | 10/1998 | Watkins et al. . | |
| 5,980,349 | * | 11/1999 | Hofmann et al. | 445/25 |
| 6,007,397 | * | 12/1999 | Ju et al. | 445/25 |

OTHER PUBLICATIONS

B.K. Ju et al., "Glass–to–Glass Wafer Anodic Bonding and Its Application to FEA/FED Micro–packaging", Asia Display 98, pp. 145–148. No date.

Kyung Sun Ryu et al., "Activation Effect of a Glass Packaged FED with Getter", Asia Display 98, pp. 689–692. No date.

* cited by examiner

*Primary Examiner*—Vip Patel
*Assistant Examiner*—Todd Reed Hopper
(74) *Attorney, Agent, or Firm*—Jacobson Holman, PLLC

(57) ABSTRACT

The present invention relates to a method of packaging a field emission display. The method of packaging a field emission display, comprising the steps of: forming an opening on a selected area of a lower substrate on which field emission elements are formed and forming a silicon layer on a lower surface of said lower substrate; combining a upper substrate, on which a transparent electrode and luminescent material are formed, and said lower substrate by a lateral wall; placing a cap on said opening after performing a vacuum process through said opening; performing a thermal treatment process so that said cap is combined with said silicon layer by silicide created by the reaction of said cap and said silicon layer, thereby sealing said opening; and completely sealing said opening by adhesives.

14 Claims, 4 Drawing Sheets

METHOD OF PACKAGING A FIELD EMISSION DISPLAY

BACKGROUND OF THE INVENTION

1. Field of the Invention

The present invention relates to a method of manufacturing a field emission display, and more particularly to a method of packaging a field emission display.

2. Description of the Prior Art

A principle of a field emission device is as follows. Voltage is applied to a gate and an emitter tip so that electrons are emitted from the emitter tip. The electrons are accelerated by anode voltage and collided to an anode on which luminescent material is deposited. The luminescent material is excited by the electrons and emits light.

FIG. 1A is a cross sectional view for explaining a conventional field emission device. As shown in FIG. 1A, the field emission device has a lower substrate 100 on which an emitter tip 101 and a gate 102 are formed, and an upper substrate 120 under which anodes having luminescent materials are formed, with the lower and upper substrates 110 and 120 are combined by a spacer 130. The field emission device must be maintained in vacuum state.

FIGS. 2A to 2C are cross sectional views for explaining a conventional method of packaging a field emission display.

Referring to FIG. 2A, a lower substrate 110 on which a field emission device 100 is formed, and an upper substrate 120 having transparent electrodes 122, on which luminescent materials 121 are deposited, respectively, are combined by spacer 130 such as frit glass. An opening is formed in the lower substrate 110 and a glass tube 140 is attached to the lower substrate so that the opening is correspond to the glass tube 140. An exhaust process is performed to be exhaust air between the upper and lower substrates 120 and 110 through the tube 140, thereby maintaining vacuum degree of $1\times10^{-7}$ Torr.

FIG. 2B is a cross sectional view to show a seal-off process. The lower part of the glass tube 140 is melted by a heater 150. If the glass tube melts some, the melt part of the glass tube 140 shrinks and is sealed off because of pressure difference by vacuum.

FIG. 2C is a cross sectional view in which the rest part of the glass tube 140 is cutted off.

However, vapor from the glass tube 140 is generated instantaneously and degrades internal vacuum at the very moment that the glass tube 140 melts in the vacuum packaging process as described above. Also, it is difficult to manufacture a field emission display with a flat board because of the long projected glass tube 140.

SUMMARY OF THE INVENTION

Accordingly, it is an object of the present invention to provide a flat field emission display of high vacuum which can solve the above problems.

To achieve the above object, a method of packaging a field emission display, comprising the steps of: forming an opening on a selected area of a lower substrate on which field emission elements are formed and forming a silicon layer on a lower surface of the lower substrate; positioning a lateral wall between an upper substrate having a transparent electrode and luminescent material formed on a lower surface thereof and the lower substrate, and combining the upper substrate, the lateral wall and the lower substrate; placing a cap on the opening after performing a vacuum process through the opening; performing a thermal treatment process to create silicide by a reaction of the cup and the silicon layer, thereby the opening is sealed by the silicide; and completely sealing the opening by using adhesives.

It is to be understood that both the foregoing general description and the following detailed description are exemplary and explanatory and are intended to provide further explanation of the invention as claimed.

BRIEF DESCRIPTION OF THE DRAWINGS

The above object, and other features and advantages of the present invention will become more apparent by describing the preferred embodiment thereof with reference to the accompanying drawings, in which.

Similar reference characters refer to similar parts in the several views of the drawings.

DETAILED DESCRIPTION OF THE PREFERRED EMBODIMENTS

Reference will now be made in detail to the preferred embodiments of the present invention, and examples of which are illustrated in the accompanying drawings.

FIGS. 3A to 3D are cross sectional views to describe a method of packaging a field emission display in accordance with a first embodiment of the present invention.

Figure 1A:
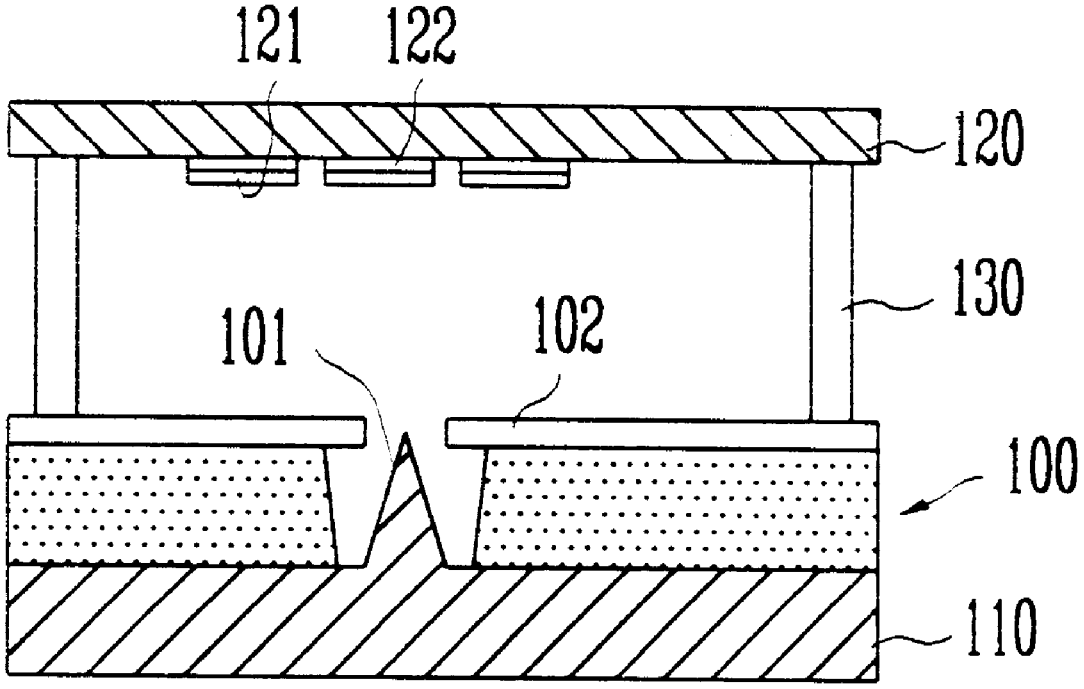
FIG. 1A (PRIOR ART)
FIG. 1A illustrates a conventional field emission display.
Figure 2A:
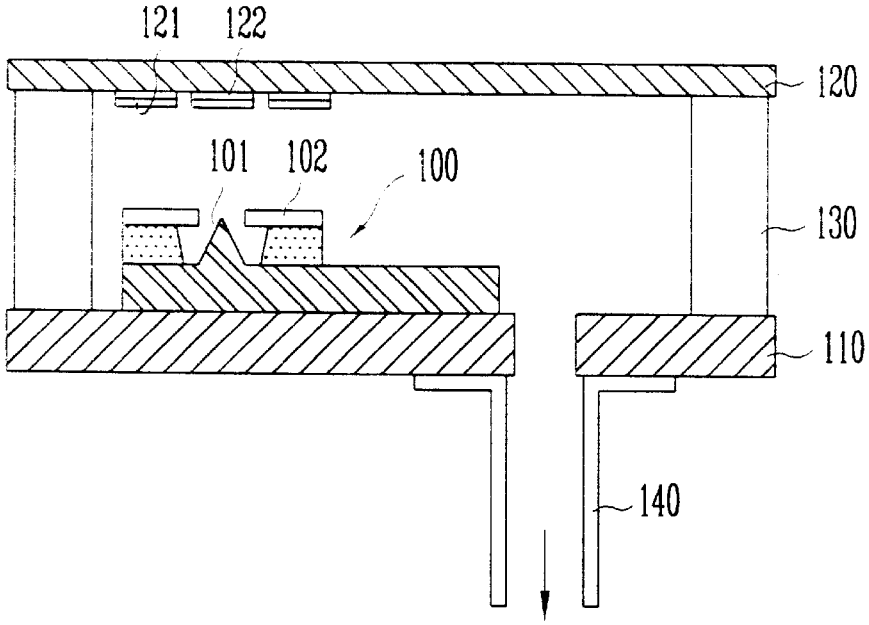
FIGS. 2A to FIG. 2C are cross sectional views to describe a method of packaging a conventional field emission display.
Figure 2B:
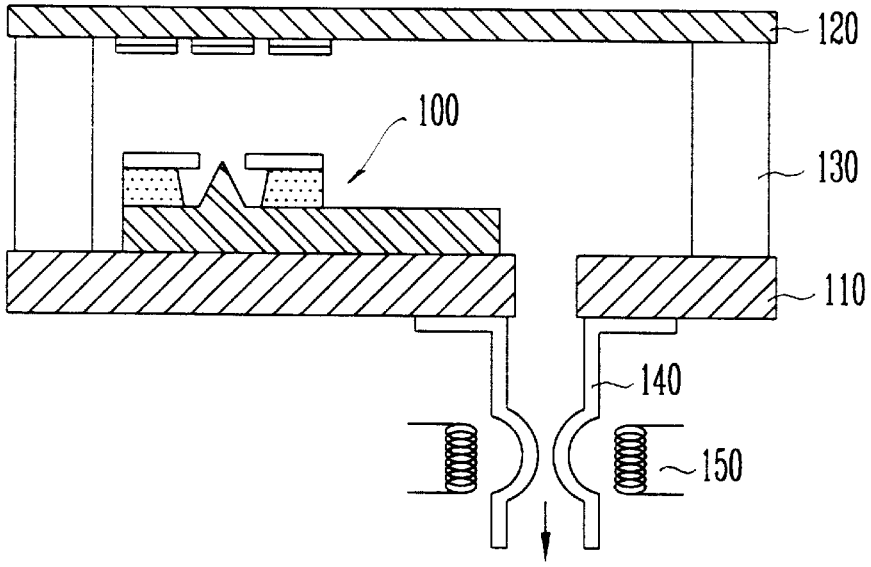
Figure 2C:
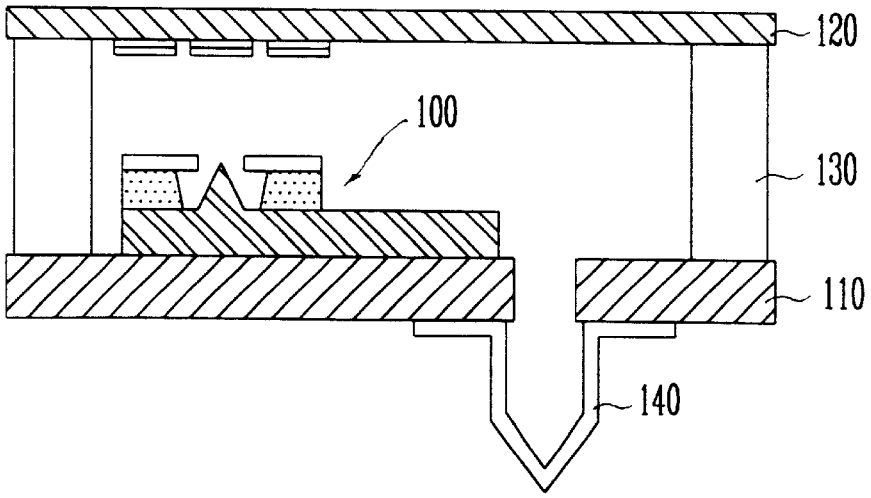
Figure 3A:
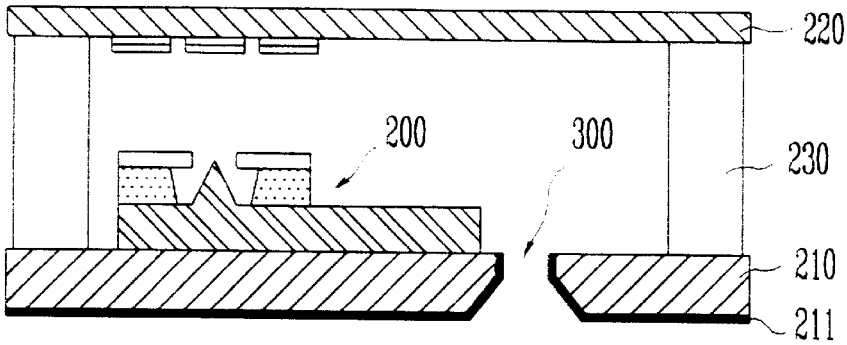
FIGS. 3A to 3D are cross sectional views to describe a method of packaging a field emission display in accordance with a first embodiment of the present invention.

As shown in FIG. 3A, an opening 300 is formed on a lower substrate 210 on which field emission elements 200 are formed and the lower surface of the lower substrate 210 is grinded. A silicon layer or a metal layer such as palladium (Pb), cobalt(Co), titanium(Ti), platinum(Pt), Chrome(Cr), Tungsten(W), Tantalum(Ta), Nickel(Ni), and Molybdnum (Mo) 211 is formed on the lower surface of the lower substrate 210. The lower substrate is combined in parallel with an upper substrate 220, by a lateral wall 230 such as frit glass.

The upper substrate 220 having a transparent electrode and luminescent material formed on a lower surface thereof.

Figure 3B:
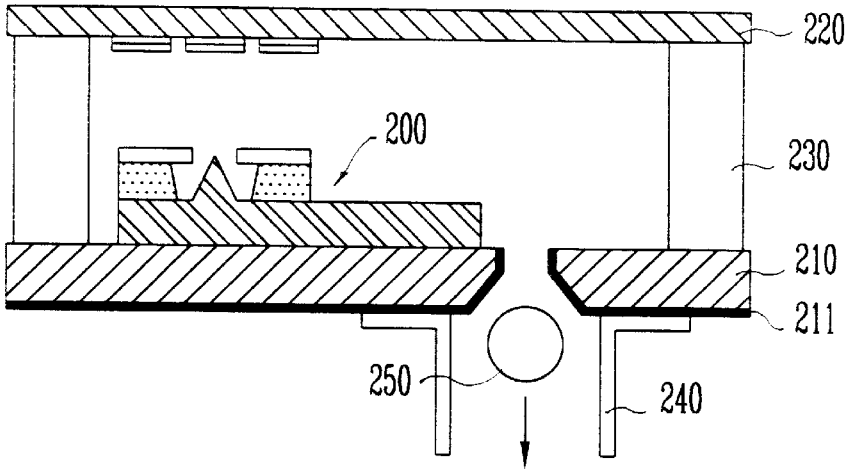

Referring to FIG. 3B, an exhausting process is performed by using the tube 240 so that vacuum is kept lower than $1\times10^{-7}$ Torr. A cap 250 such as a spherical metal cap is positioned at the opening 300 and a tube 240 is temporally attached so that the opening 300 is corresponded to the tube 240. An exhausting process is performed by using the tube 240 so that vacuum is kept lower than $1\times10^{-7}$ Torr. The cap 250 is made of silicon or metal such as Pd, Co, Ti and Pt. The cap 250 may be made of material, which surface thereof is coated by silicon or metal.

Figure 3C:
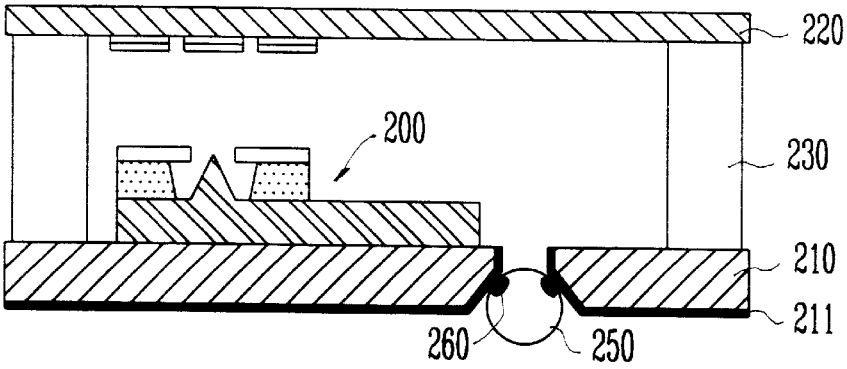

As shown in FIG. 3C, let silicide 260 be formed by the reaction of the silicon layer 211 and the metal cap 250 by thermal treatment at the temperature of 100–900 degree Celsius that the glass tube does not melt, after checking internal vacuum. That is, the cap 250 is combined with the silicon layer 211 by the silicide 260.

It is possible to proceed with the silicide forming process in a high vacuum chamber instead of forming a vacuum through the glass tube 240 in the above process. In the above thermal treatment, an electric furnace or a rapid thermal annealing furnace is used. The glass tube 240 is removed if vacuum sealing is completed.

Figure 3D:
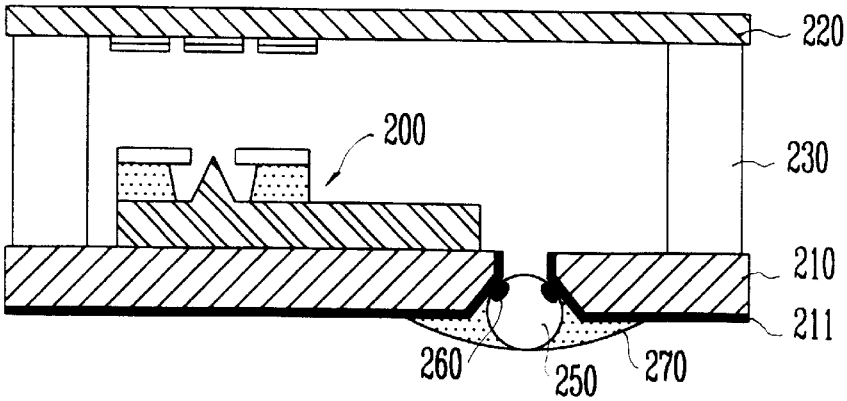

FIG. 3D is a cross sectional view to seal the opening using adhesives 270 such as epoxy or resin to improve sealing strength of the silicide 260.

Figure 4A:
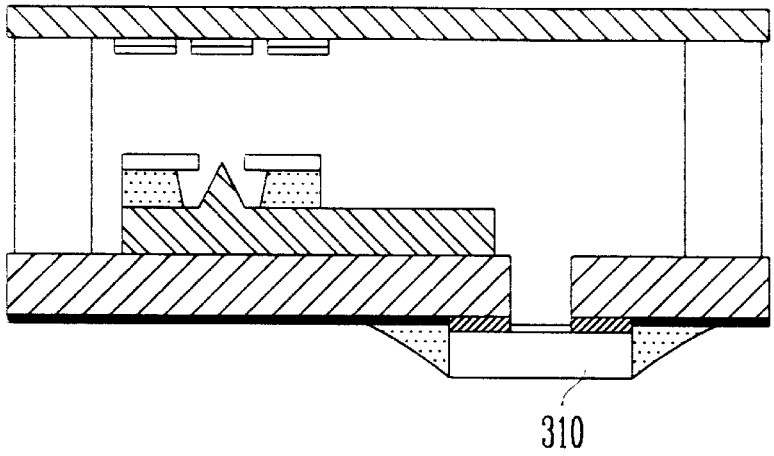
FIGS. 4A to 4C are cross sectional views illustrating a method of packaging a field emission display in accordance with a second, third and fourth embodiments of the present invention.
Figure 4B:
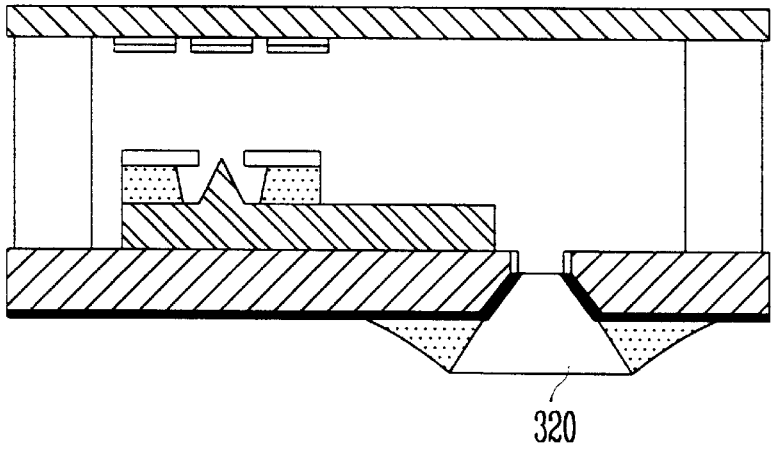
Figure 4C:
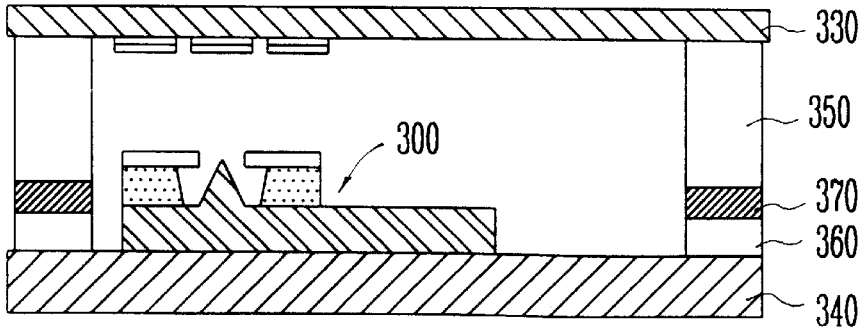

FIGS. 4A to 4C are cross sectional views illustrating a method of packaging a field emission display in accordance with a second, third and fourth embodiments of the present invention. A disk type metal cap 310 is used in the sealing process by silicide forming in FIG. 4A and a conic metal cap 320 in FIG. 4B.

FIG. 4C is a cross sectional view to describe direct packaging in a high vacuum chamber, without making an opening for exhaust. A lower substrate 340 having a field emission elements 300 formed on an upper surface thereof and a first lateral wall 360 formed on edge of the upper surface is provided. An upper substrate 330 having transparent electrodes formed on a lower surface thereof and a second lateral wall 350 formed on edge of the lower surface is provided. The first lateral wall 360 is made of metal or silicon and the second lateral wall 350 is made of silicon or metal. The first and second lateral walls 360 and 350 are sealed by silicide 370 created by reaction between the first and second lateral walls 360 and 350. The silicide 370 is created in a high vacuum chamber.

As described above, the present invention may not only prevent vacuum from dropping by vapor in the glass tube because packaging without a glass tube proceeds with the silicide forming process by the reaction of metal and silicon, using a cap for the opening for exhaust, but may provide excellent effect to manufacture a flat field emission display. If the above process proceeds in a high vacuum chamber, manufacturing productivity improves and unit cost of a flat display may be reduced because the exhaust process and the sealing-off process for vacuum are performed at the same time.

While the present invention has been described and illustrated herein with reference to the preferred embodiment thereof, it will be understood by those skilled in the art that various changes in form and details may be made therein without departing from the spirit and scope of the invention.

What is claimed is:

1. A method of packaging a field emission display, comprising steps of:

forming an opening on a selected area of a lower substrate on which field emission elements are formed and forming a silicon layer on a lower surface of said lower substrate;

positioning a lateral wall between an upper substrate, which has a transparent electrode and luminescent material formed on a lower surface thereof and the lower substrate, and combining the upper substrate, the lateral wall and the lower substrate;

placing a cap on said opening after performing a vacuum process through said opening;

performing a thermal treatment process to create silicide by a reaction of the cap and the silicon layer, thereby the opening is sealed by the silicide; and completely sealing said opening by using adhesives.

2. The method as claimed in claim 1, wherein said cap is any one of Palladium(Pd), cobalt(Co), Titanium(Ti), Platinum(Pt), Chrome(Cr), Tungsten(W), Tantalum(Ta), Nickel(Ni) and Molybdenum(Mo).

3. The method as claimed in claim 1, wherein the shape of said cap is any one of spherical type, disk type and conic type.

4. The method as claimed in claim 1, wherein said thermal treatment process is executed in the temperature of 100–900 degree Celsius by furnace or rapid thermal annealing(RTA).

5. The method as claimed in claim 1, wherein said thermal treatment process is performed in a high vacuum chamber instead of forming a vacuum through the tube.

6. A method of packaging a field emission display, comprising:

forming an opening on a selected area of a lower substrate on which field emission elements are formed and forming a metal layer on a lower surface of said lower substrate;

positioning a lateral wall between an upper substrate, which has a transparent electrode and luminescent material formed on a lower surface thereof, and the lower substrate, and combining the upper substrate, the lateral wall and the lower substrate;

placing a cap on said opening after performing a vacuum process through said opening;

performing a thermal treatment process to create silicide by a reaction of the cap and the metal layer, thereby the opening is sealed by the silicide; and completely sealing said opening by using adhesives.

7. The method as claimed in claim 6, wherein said metal layer is any one of Palladium(Pd), cobalt(Co), titanium(Ti), platinum(Pt), Chrome(Cr), Tungsten(W), Tantalum(Ta), Nickel(Ni) and Molybdenum(Mo).

8. The method as claimed in claim 6, wherein the shape of said cap is any one of spherical type, disk type and conic type.

9. The method as claimed in claim 6, wherein said thermal treatment process is executed in the temperature of 100–900 degree Celsius by furnace or rapid thermal annealing(RTA).

10. The method as claimed in claim 6, wherein said thermal treatment process is performed in a high vacuum chamber instead of forming a vacuum through the tube.

11. A method of packaging a field emission display, comprising steps of:

providing a lower substrate having a field emission element formed on an upper surface thereof and a first lateral wall formed on edge of said upper surface;

providing an upper substrate having transparent electrodes formed on a lower surface thereof and a second lateral wall formed on edge of said lower surface;

sealing said first and second lateral walls in a high vacuum chamber by means of a reactant created by reaction between said first and second lateral walls.

12. The method as claimed in claim 11, wherein said first lateral wall is made of metal, and said second lateral wall is made of silicon.

13. The method as claimed in claim 12, wherein said metal is anyone of Palladium(Pd), cobalt(Co), titanium(Ti), platinum(Pt), Chrome(Cr), Tungsten(W), Tantalum(Ta), Nickel(Ni), and Molybdnum(Mo).

14. The method as claimed in claim 11, wherein said reactant is silicide wherein said thermal process is executed in the temperature of 100–900 degree Celsius by furnace or rapid thermal annealing (RTA).

* * * * *